United States Patent [19]

Boyer et al.

[11] Patent Number: 4,706,639

[45] Date of Patent: Nov. 17, 1987

[54] INTEGRATED DIRECT IGNITION MODULE

[75] Inventors: James A. Boyer; Bobbie D. Bridgewater, both of Anderson, Ind.; Donald C. Warner, Byron; Jerry L. Sturdivant, Rochester Hills, both of Mich.

[73] Assignee: General Motors Corporation, Detroit, Mich.

[21] Appl. No.: 937,941

[22] Filed: Dec. 4, 1986

[51] Int. Cl.[4] ..... F02P 15/00

[52] U.S. Cl. ..... 123/647; 123/143 C; 123/169 PA; 123/635

[58] Field of Search ..... 123/634, 635, 636, 637, 123/643, 647, 169 PA, 143 C; 339/26

[56] References Cited

U.S. PATENT DOCUMENTS

| | | | |
|---|---|---|---|
| 995,400 | 6/1911 | Cavanagh | 123/634 |
| 1,008,351 | 11/1911 | Merritt | 315/57 |
| 1,011,884 | 12/1911 | Cavanagh | 315/289 |
| 1,378,260 | 5/1921 | Melton | 123/143 C |
| 1,532,292 | 4/1925 | Woolson | 123/621 |
| 1,692,087 | 11/1928 | Matthew et al. | 123/143 C |
| 2,446,888 | 8/1948 | Sheridan et al. | 361/268 |
| 2,478,128 | 8/1949 | Peters | 123/143 C |
| 2,509,093 | 5/1950 | Field | 123/143 C |
| 2,632,132 | 3/1953 | Delano | 315/57 |
| 3,104,658 | 9/1963 | Olsen | 123/143 C |
| 3,153,561 | 10/1964 | Cooney | 439/86 |
| 3,202,146 | 8/1965 | Short et al. | 123/415 |
| 3,311,783 | 3/1967 | Gibbs et al. | 315/226 |
| 3,339,010 | 8/1967 | Brentrup | 174/72 A |
| 3,716,038 | 2/1973 | Bevacqua | 123/634 |
| 3,871,737 | 3/1975 | Dorrell et al. | 439/88 |
| 3,935,852 | 2/1976 | Donovan et al. | 123/647 |
| 4,195,611 | 4/1980 | Wörz et al. | 123/647 |
| 4,248,201 | 2/1981 | Tsutsui et al. | 123/647 |
| 4,382,430 | 5/1983 | Iwasaki | 123/606 |
| 4,392,473 | 7/1983 | Tsutsui et al. | 123/635 |
| 4,404,951 | 9/1983 | Zechlin et al. | 123/647 X |
| 4,432,323 | 2/1984 | Iwasaki | 123/427 |
| 4,446,842 | 5/1984 | Iwasaki | 123/606 |
| 4,461,264 | 7/1984 | Iwasaki | 123/635 |
| 4,463,744 | 8/1984 | Tanaka et al. | 123/643 |
| 4,480,377 | 11/1984 | House et al. | 29/593 |
| 4,515,141 | 5/1985 | Saaf et al. | 123/647 |
| 4,617,907 | 10/1986 | Johansson et al. | 123/647 |
| 4,621,881 | 11/1986 | Johansson et al. | 339/26 |
| 4,637,368 | 1/1987 | Gillbrand et al. | 123/647 |

FOREIGN PATENT DOCUMENTS

| | | |
|---|---|---|
| 1148814 | 1/1964 | Fed. Rep. of Germany . |
| 1232399 | 1/1967 | Fed. Rep. of Germany . |
| WO84/00402 | 2/1984 | World Int. Prop. O. . |
| 1170151 | 11/1969 | United Kingdom . |
| 1371042 | 10/1974 | United Kingdom . |
| 1498942 | 1/1978 | United Kingdom . |

*Primary Examiner*—Willis R. Wolfe, Jr.
*Attorney, Agent, or Firm*—C. R. Meland

[57] ABSTRACT

An ignition module that is adapted to be secured to an internal combustion engine. The module has a plastic housing and a metallic cover that is adapted to be secured to an engine. A plurality of ignition coils are located within the housing and cover. The lower wall of the plastic housing has conductors embedded therein that electrically connect the secondary windings of the coils to electrical connector assemblies that are carried by the housing and which are adapted to slip over the spark plugs of an engine. The connector assemblies include means for making an electrical connection to the terminals of the spark plugs. The ignition coils have laminated cores that are clamped between the housing and the cover. The cores directly contact the metallic cover so that the cores have a heat transfer path to the cover and are electrically connected to the cover.

7 Claims, 9 Drawing Figures

INTEGRATED DIRECT IGNITION MODULE

This invention relates to an integrated direct ignition module for an internal combustion engine which has a plurality of ignition coils and connector means for electrically connecting the secondary windings of the ignition coils to pairs of spark plugs of the engine when the module is secured to an internal combustion engine.

Ignition apparatus that is adapted to be mounted on an internal combustion engine and which includes a plurality of ignition coils that are connectable to the spark plugs is known, one example being the ignition apparatus disclosed in PCT International Published application having an International Publication Number WO 84/00402. In this published application a so-called ignition cassette is provided which carries a plurality of ignition coils and the secondary winding of each coil is connected to a spark plug. Accordingly, the number of ignition coils that are required is equal to the number of spark plugs for the engine.

In contrast to the above-referenced PCT published patent application it is an object of this invention to provide an ignition module wherein the secondary windings of the ignition coils are respectively connected to a pair of spark plugs. In carrying this object forward an ignition module is provided which includes a plastic housing and a metallic cover member. The cover is adapted to be bolted to an internal combustion engine. The plastic housing has a lower wall that has a plurality of conductors embedded therein. These conductors are electrically connected to a plurality of electrical connector assemblies that are carried by the plastic housing and which are adapted to be slipped over the spark plugs of the engine when the module is assembled to an internal combustion engine. The ignition module carries a plurality of ignition coils, the secondary windings of which are electrically connected to the conductors embedded in the lower wall of the plastic housing by electrically conductive springs. The arrangement of conductors is such that opposite ends of a secondary winding become electrically connected to a pair of spark plugs when the module is assembled to an internal combustion engine. Thus, the number of ignition coils required is equal to one-half the number of spark plugs for the engine.

Another object of this invention is to provide an ignition module which is capable of electrically connecting the secondary winding of an ignition coil to a spark plug and wherein the module comprises a metallic cover and further wherein the laminated core of the ignition coil is electrically and thermally connected to the metallic cover. In carrying this object forward the ignition coil is secured to the cover and housing of the module such that the laminated core is in direct metal-to-metal contact with the metallic cover. With this arrangement, heat generated in the laminated magnetic core is transferred to the metallic cover where it is dissipated to the surrounding air. In addition, the laminated core is electrically connected to motor vehicle ground since the metallic cover is connected to motor vehicle ground when it is secured to a metallic portion of the engine.

IN THE DRAWINGS

The ignition module of this invention will be described for use with a 4-cylinder internal combustion engine.

Figure 1:
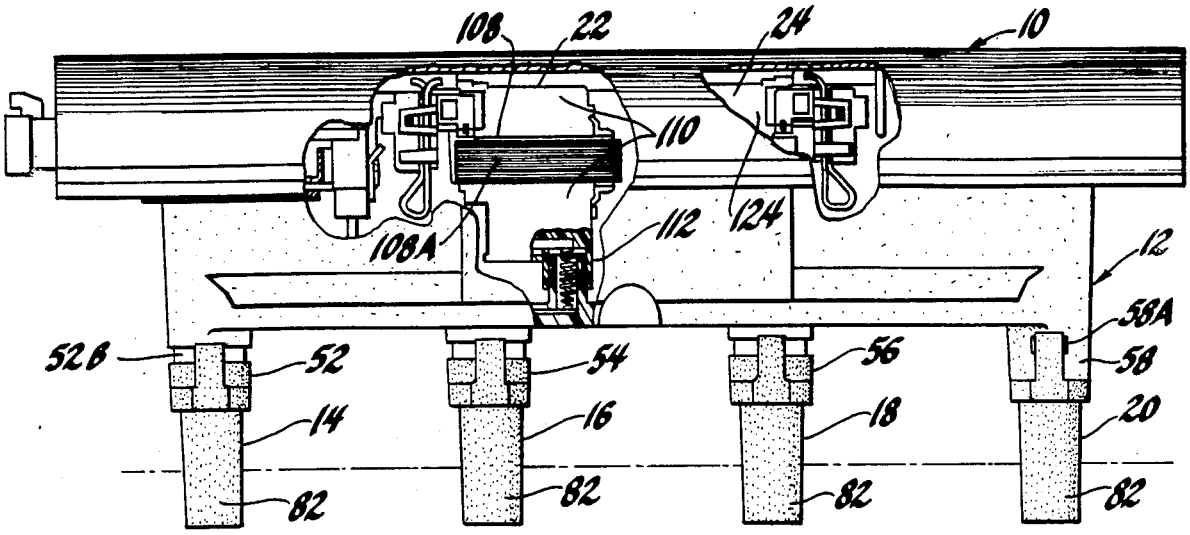
FIG. 1 is a side view with parts broken away of an ignition module made in accordance with this invention.
Figure 2:
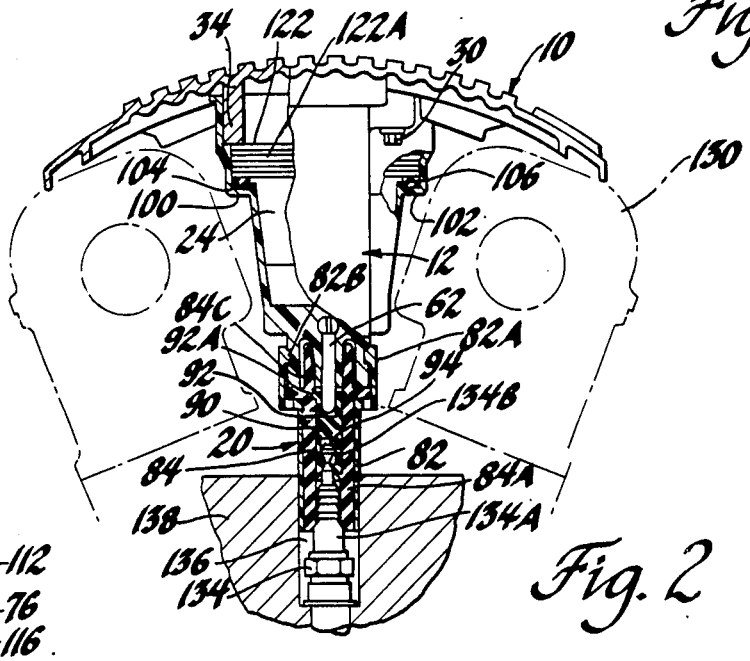
FIG. 2 is an end view with parts broken away of the ignition module shown in FIG. 1 and also illustrating how the module is positioned when it is mounted to an internal combustion engine.
Figure 6:
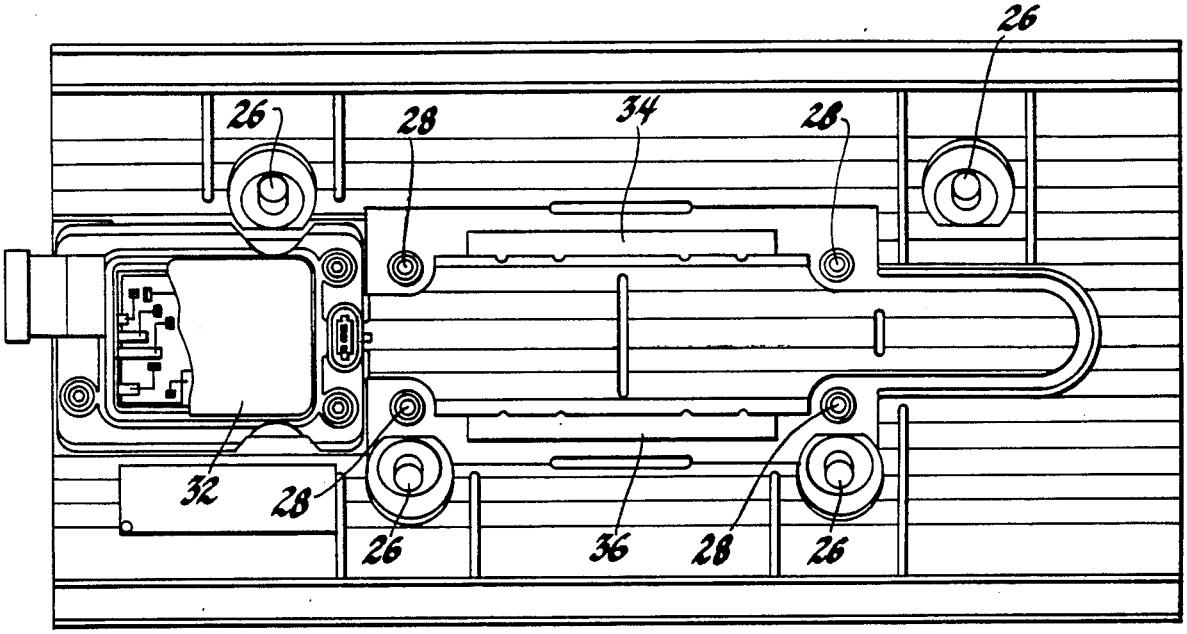
FIG. 6 is a plan view of the underside of a cover member which forms a part of the ignition module illustrated in FIG. 1.

Referring now to the drawings and more particularly to FIG. 1, the reference numeral 10 generally designates a cover which is formed of aluminum material. The cover 10 can be formed by die-casting and, as illustrated in FIG. 2, the cover is curved and has longitudinally extending ribs. The cover 10, as will be more fully described hereinafter, is bolted to an internal combustion engine in order to secure the module to the engine. The cover 10 carries a housing generally designated by reference numeral 12 which is formed of a plastic insulating material. The housing 12 carries four electrical connector assemblies 14, 16, 18 and 20. The module shown in FIG. 1 has two ignition coils 22 and 24 which are clamped between the cover 10 and portions of the plastic housing 12 in a manner that will be more fully described hereinafter. The cover 10 has four bolt holes 26 which are adapted to receive bolts for attaching the cover to an internal combustion engine. The cover 10 further has four threaded openings 28 which are adapted to receive the ends of screws or fasteners for securing the housing 12 to the cover 10. One of these fasteners is illustrated in FIG. 2 and designated by reference numeral 30. The cover 10 carries an electronic module 32 which controls the primary winding current for the primary windings of the ignition coils. The cover 10 is provided with a pair of axially extending walls or rails 34 and 36 which are illustrated in FIG. 6. As will be more fully described hereinafter, the end surfaces of walls 34 and 36 engage portions of the laminated cores for the ignition coils 22 and 24.

The housing 12 is provided with openings 38 that are adapted to receive the screws 30 for fastening the housing 12 to the cover 10. The housing 12 has a lower wall portion 40 which has embedded therein a plurality of electrical conductors 42, 44, 46 and 48 shown in FIG. 5. These conductors may be formed of tin plated brass and are molded into the lower wall 40 of the plastic housing 12. The conductor 48 has an integral plug terminal portion 50 which extends through and is molded to an annular boss 52 which is an integral part of the housing 12. The boss 52 has an annular internal recess 52A which is adapted to receive the upper end of connector assembly 14 in a manner to be described. The boss 52 further has an outer annular groove 52B. The housing 12 further has integral bosses 54, 56 and 58. The bosses 52, 54 and 56 are identical and the boss 58 is identical to the other bosses with the exception that instead of having an annular outer groove like groove 52B it has a pair of opposed recesses 58A.

As previously mentioned, one end of conductor 48 is connected to the plug-type male terminal 50 and the other end of this conductor is connected to an integral circular pad 60. In a similar fashion, the conductor 42 connects plug-type terminal 62 to integral pad 64, conductor 44 connects plug-type terminal 66 to pad 68 and conductor 46 connects plug-type terminal 70 to pad 72. In fabricating the housing illustrated in FIGS. 3 and 4 the conductors that are embedded in the lower wall of the housing may be molded to a flexible part formed of plastic material and then this part is overmolded to form the housing 12.

Figure 4:
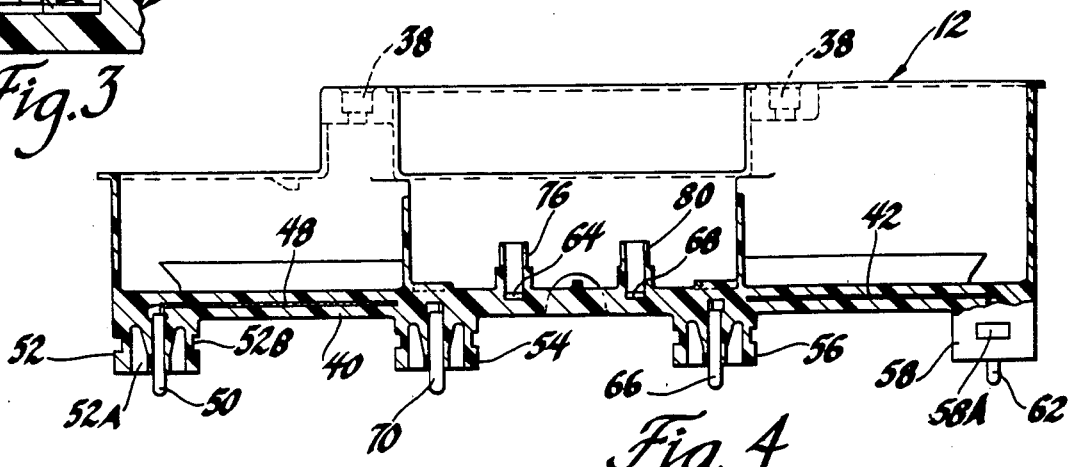
FIG. 4 is a sectional view of a housing which forms a part of the ignition module shown in FIG. 1.

Extending from the lower wall of the housing 12 are four integral tubular portions 74, 76, 78 and 80. These tubular portions define bores that are respectively aligned with the annular pads of the conductors that are embedded in the lower wall of the housing. Thus, as illustrated in FIG. 4, the bore of the tubular portion 76 is aligned with the annular pad 64 and the bore of tubular portion 80 is aligned with the pad 68. The same is true for tubular portions 74 and 78.

Figure 7:
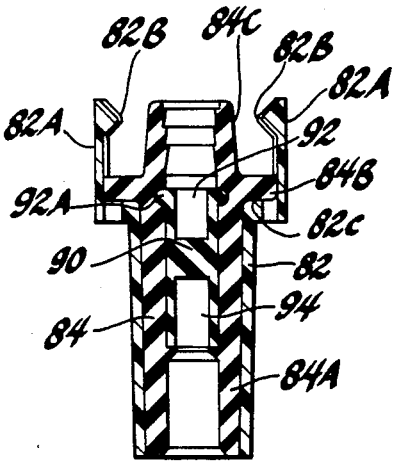
FIG. 7 is a sectional view of a connector assembly which are utilized as components of the ignition module shown in FIG. 1.

The connector assemblies 14–20 are all identical and one of these connector assemblies 20 is illustrated in detail in FIG. 7. The connector assembly, as illustrated in FIG. 7, comprises a tubular retainer member 82 which is formed of a molded plastic material. The tubular member 82 has a pair of opposed integral resilient latch arms 82A, each having a tooth 82B which snap into grooves like groove 52B or recesses 58A when a connector assembly is assembled to a boss portion of the housing 12. The tubular member 82 carries a tubular rubber insert or boot 84. The lower end 84A of boot 84 engages the insulator portion of a spark plug in a manner to be more fully described. The boot 84 is press-fitted to tubular member 82 and it has an annular flange portion 84B a surface of which engages a surface 82C of part 82. The latch arms may be provided with grooves for receiving annular portion 84B. The boot 84 has an upper tubular portion 84C.

Disposed within the tubular rubber member or boot 84 is an electrical connector or conductor 90 which has opposed bores 92 and 94. The electrical connector 90 is formed of a silicone rubber material which has been loaded with carbon so that this rubber material is electrically conductive and may have a resistance of less than 200 ohms. The connector 90 is press-fitted into boot 84 and has an annular bead 92A that fits into a complementary groove formed in boot 84.

When a connector assembly, such as connector assembly 20, is assembled to a housing 12 it is fitted to a boss such that the teeth 82B of latch arms 82A snap into the recesses 58A or into grooves like groove 52B. As a connector assembly is assembled to the housing 12 the internal surface defining bore 92 of a conductor 90 engages a plug terminal such as terminal 62 so that the electrical conductor 90 is electrically connected to the male plug-type terminal 62. This is illustrated in FIG. 2. When a connector assembly is assembled to the housing 12 a portion 84C of a boot 84 is inserted into a groove like groove 52A. Further, annular portion 84B of boot 84 is clamped between a lower surface of a boss and surface 82C of tubular part 82 as is illustrated in FIG. 2.

Figure 5:
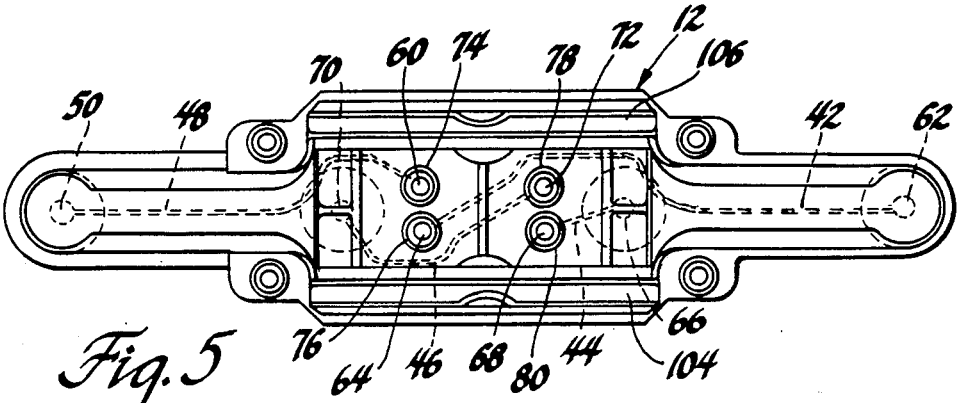
FIG. 5 is a plan view of the housing illustrated in FIG. 4.

Referring to FIGS. 2 and 5, it is pointed out that the housing 12 has a pair of opposed axially extending walls 100 and 102 and surfaces of these walls respectively carry a rubber strip or shim designated respectively by reference numerals 104 and 106. These rubber strips or shims are adhesively secured to the surfaces of housing 12. As will be more fully described hereinafter, surface areas of the laminated cores of the ignition coils engage the shims 104 and 106 when the ignition coils are assembled to the cover 10 and housing 12.

Figure 3:
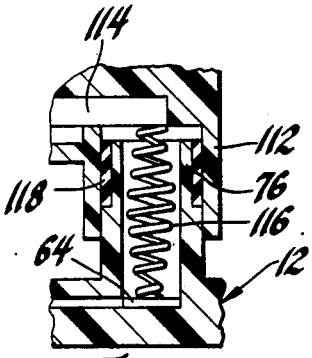
FIG. 3 is an enlarged view of a portion of FIG. 1.

The ignition coils 22 and 24 each have a magnetic core that is of the shape illustrated in the U.S. Pat. No. 4,480,377 to House et al. The disclosure of this patent is incorporated by reference. Thus, the core of each ignition coil is formed from a stack of electrical steel laminations. The core configuration is such that a center leg is provided and the primary and secondary windings are disposed about this center leg. The outer configuration of the laminated core is rectangular, as shown in the above-referenced U.S. Pat. No. 4,480,377. One side of the rectangular portion 108 of the core for ignition coil 22 is illustrated in FIG. 1 and is designated as 108A. The primary and secondary windings of coil 22 are disposed about the center leg of the core and are enclosed by a plastic housing 110. This plastic housing 110 does not encapsulate or enclose the rectangular portion of the laminated core. The housing 110 has a pair of tubular portions 112, one of which is illustrated in FIGS. 1 and 3. These tubular portions 112 are positioned so that they are aligned with tubular portions 74 and 76 of housing 12 when this housing is secured to cover 10 and the tubular portions 112 receive the tubular portions 74 and 76.

Referring now to FIG. 3, a tubular portion 76 of housing 12 is shown disposed or telescoped within a tubular portion 112 of the plastic housing of ignition coil 22. FIG. 3 illustrates the positions of the parts when the ignition coils, the cover 10 and housing 12 have been assembled together. The housing 110 carries a conductor 114 which is electrically connected to one side of the secondary winding of ignition coil 22. The conductor 114 is electrically connected to a pad portion 64 by an electrically conductive spring 116, the opposite ends of which respectively engage conductor 114 and pad 64. This spring may be formed of stainless steel and it is compressed between conductor 114 and pad 64. The pad 64 is connected to conductor 42 and hence to male terminal 62, as illustrated in FIG. 5. Disposed between the tubular portion 76 and tubular portion 112 is an elastomeric tubular seal 118 that may have outer ribs. The seal is compressed between tubular portions 76 and 112. The pad 60 is electrically connected to another conductor, like conductor 114, by another spring like spring 116. This other conductor is connected to the opposite side of the secondary winding of coil 22. From the foregoing it will be apparent that opposite ends of the secondary winding of coil 22 are connected respectively to male terminals 50 and 62.

The ignition coil 24 is identical with ignition coil 22 and an end 122A of the outer rectangular portion 122 of the laminated core for this coil is illustrated in FIG. 2. The coil 24 has a plastic housing 124 that has a pair of tubular portions (not illustrated) like tubular portion 112, shown in FIG. 3. These tubular portions receive tubular portions 78 and 80 of housing 12. Springs, like the spring 116, are utilized to electrically connect conductors, like conductors 114, to pads 68 and 72. Therefore, the opposite ends of the secondary winding of coil 24 are connected to pads 68 and 72 and hence to male terminals 66 and 70.

The manner in which the ignition module is assembled will not be described. In making this assembly the springs 116 are placed in the tubular portions 74, 76, 78 and 80 of housing 12. The ignition coils are now positioned such that tubular portions 76–80 of housing 12 slide into tubular portions of the ignition coils such as tubular portion 112. A pair of parallel lower surfaces of each laminated core, for each ignition coil, now engage respectively the shims 104 and 106. This is illustrated in FIG. 2 where it is seen that parallel lower surfaces of the rectangular portion 122 of the core for coil 24 respectively engage upper surfaces of shims 104 and 106. Coil 22 is supported in the same fashion.

When the screws 30 are tightened to secure cover 10 to housing 12 the cores of coils 22 and 24 are tightly clamped between shims 104 and 106 and end surfaces of walls 34 and 36. This is depicted in FIG. 2 where rectangular core portion 122 is shown clamped between an end surface of wall 34 and shim 104. Wall 36 is not shown in FIG. 2 but it is identical with wall 34. From the foregoing it will be apparent that one side of core portion 122 is clamped between shim 104 and the end surface of wall 34 and the other side of core portion 122 is clamped between shim 106 and the end surface of wall 36. The ignition coil 22 is mounted in the same manner, that is, sides of core portion 108 are clamped between shims 104 and 106 and end surfaces of walls 34 and 36.

The upper surfaces of the magnetic cores for both coils 22 and 24 are in direct metal-to-metal contact with surfaces of rails or walls 34 and 36 of aluminum cover 10. The cores for the coils accordingly are electrically and thermally directly connected to cover 10.

Since the laminated magnetic cores for the ignition coils directly contact the cover member 10 the heat generated in these cores is transferred to the metallic cover member 10 which acts as a heat dissipater to dissipate the heat to the surrounding air. In addition, when the ignition module is mounted to a metallic portion of an internal combustion engine the cover member 10 is at motor vehicle electrical ground. Accordingly, the laminated cores of the ignition coils are grounded. Since these cores are grounded, any voltages developed due to capacitance between parts of the ignition coil and the core are directly shunted to ground so that any voltages developed by such a capacitance will not cause a destructive arc over.

Figure 8:
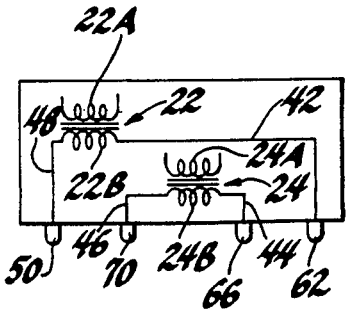
FIG. 8 is a schematic circuit diagram of the connections between the secondary winding of the ignition coils that form a part of the ignition module shown in FIG. 1 and terminals of the ignition module.

FIG. 8 is a schematic circuit diagram of the electrical connections of the secondary windings of ignition coils 22 and 24 with the plug-type male terminals of the module. In FIG. 8, the same reference numerals have been utilized as were used previously in order to identify corresponding circuit elements. In FIG. 8, the primary of ignition coil 22 has been designated as 22A and the secondary winding as 22B. The primary winding of ignition coil 24 is designated as 24A and the secondary winding as 24B. The secondary winding 22B is shown connected to male terminals 50 and 62 by conductors 48 and 42. The male terminals 70 and 66 are shown electrically connected to the secondary winding 24B by conductors 44 and 46. These electrical connections correspond to the conductors embedded in the lower wall of the housing 12 as illustrated in FIG. 5.

The electrical conductors that are embedded in the lower wall of housing 12, such as conductor 42, can take various configurations. Thus, a given conductor may be arranged so that portions of the conductor lie in a plane that is normal or perpendicular to an adjacent portion of a conductor, that is, a part of the conductor may be twisted so that it lies normal to another portion of the conductor. Thus, where the conductors terminate in a pad such as pad 64 the conductor portion adjoining the pad 64 may lie in a plane that is normal to the plane of the remainder of the conductor. By way of example, and not by way of limitation, the conductors that are embedded in lower wall 40, such as conductor 42, are rectangular in cross section and may be about 1 mm thick and 3 mm wide.

As previously mentioned, the ignition module shown in FIG. 1 is bolted to an internal combustion engine by passing bolts through bolt openings 26 and into threaded openings in a metallic portion of the engine. The position of the ignition module, relative to an engine and one spark plug of a 4-cylinder engine, is illustrated in FIG. 2. In FIG. 2 reference numerals 130 and 132 identify metallic cam covers for an internal combustion engine. The ignition module is positioned such that the housing 12 is disposed between the cam covers and the cover member 10 is bolted to the cam covers by bolts which are not illustrated. In FIG. 2 one of the connector assemblies 20 is shown connected to a spark plug 134 of the engine. The spark plug 134 is located within a cylindrical bore or well 136 formed in the engine head 138. The spark plug 134 has an insulator portion 134A and a terminal 134B. It can be seen that when the module is mounted to the engine the boot portion 84A engages the insulator portion 134A of the spark plug. The wall of the bore 94 of the conductive rubber insert 90 engages the terminal portion of the spark plug. The internal wall of bore 92 receives and engages one of the plug-type terminals 62. Accordingly, the conductive rubber insert 90 electrically connects the terminal 62 to the terminal 134B of the spark plug. The other connector assemblies serve to connect other plug-type male terminals to the other three spark plugs and in this regard the engine is arranged such that all of the spark plugs are aligned as are the connector assemblies.

The primary windings 22A and 24A are electrically connected to the electronic control module 32 by conductors which have not been illustrated. The electronic control module includes transistor switching devices connected to the primary windings 22A and 24A which make and break the primary winding circuit in a manner well known to those skilled in the art. When the primary winding current is shut off a voltage is induced in a secondary winding to cause two spark plugs to be fired in series. Thus, for example, when a large voltage is induced in secondary winding 22B it will cause two spark plugs to be fired that are connected to plug-type terminals 50 and 62. The arrangement is such that one of the cylinders associated with one of the spark plugs is in its compression stroke while the spark plug associated with the other cylinder is in its exhaust stroke. The electronic control module is controlled in response to engine crankshaft position by suitable sensing devices that respond to crankshaft position. What has been described is well known to those skilled in the art and the electronic system for causing a pair of spark plugs to be fired sequentially can take various configurations.

The electronic components of the electronic control module are mounted so that heat dissipated by the electronic control module is transferred to the metallic cover 10. Moreover, the metallic cover 10 provides an electrical ground which in turn provides a ground connection for the components of the electronic control module 32.

Figure 9:
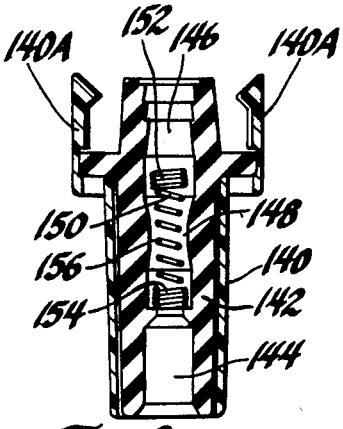
FIG. 9 is a sectional view of a modified connector assembly.

Referring now to FIG. 9, a modified connector assembly is illustrated which can be used instead of the connector assembly shown in FIG. 7. In FIG. 9 reference numeral 140 designates a tubular retainer member which is formed of a molded plastic material. The retainer member 140 has opposed latch arms 140A which perform the same function as latch arms 82A shown in FIG. 7. The tubular member 140 carries a tubular rubber insert or boot 142. The boot has a bore 144 the inner surface of which engages the insulator portion of the spark plug. The boot 144 further has an upper bore 146 that is adapted to receive a plug-type terminal 50. The bores 144 and 146 are open to an intermediate hour-glass shaped bore 148. An electrically conductive stainless steel spring generally designated by reference numeral 150 is located in bore 148. The spring 150 has circular end portions 152 and 154 that are defined by turns of wire that engage each other and an intermediate portion 156 where the turns do not engage each other. The outer diameter of the turns of the portion 156 are such that they define a generally hour-glass configuration generally matching the hour-glass bore 148. This serves to retain the spring after it is inserted into the bore. The portion 152 of spring 150 engages the end of a terminal 50 and the portion 154 engages the conical end of spark plug terminal 134B when the module is assembled to an engine to thereby electrically connect a terminal 50 and a spark plug terminal 134B. The inner diameter of circular spring portions 152 and 154 are so related to the outer diameter of terminals 50 and 134B that the spring portions do not slide over the terminals. Putting it another way, the conical ends of terminals 50 and 134B fit into and contact spring portions 152 and 154 but the spring portions do not slide over the maximum diameter portions of terminals 50 and 134B.

The embodiments of the invention in which an exclusive property or privilege is claimed are defined as follows:

1. An ignition module that is adapted to be mounted on an internal combustion engine and which is operative to electrically connect the secondary winding of an ignition coil to a spark plug of the engine comprising, a housing formed of electrical insulating material having a wall that faces the spark plug when the module is mounted on an engine, a metallic cover secured to said housing, said cover being adapted to be secured to said engine, an ignition coil disposed within said housing and cover having a laminated magnetic core and a secondary winding, said magnetic core being clamped between said housing and said metallic cover with a portion of said core directly engaging said cover whereby said core has a direct heat transfer path to said cover and is electrically connected to said cover, a tubular member formed of insulating material secured to said wall, said tubular member carrying a conductor means that is adapted to engage a terminal of a spark plug, the tubular member being positioned to slip over the spark plug when the module is assembled to the engine, and means connecting said secondary winding to said conductor means that is carried by said tubular member and which is adapted to engage a terminal of said spark plug.

2. The ignition module according to claim 1 where a shim formed of elastomeric material is interposed between said housing and said core.

3. An ignition module that is adapted to be mounted on an internal combustion engine and which is operative to electrically connect the secondary windings of a plurality of ignition coils to the spark plugs of the engine such that a secondary winding is connected to a pair of spark plugs comprising, a housing formed of electrical insulating material having a wall that faces the spark plugs when the module is mounted on an engine, a plurality of tubular members formed of insulating material secured to said wall, each tubular member carrying a conductor means that is adapted to engage a terminal of a spark plug, the tubular members being positioned to slip over a plurality of spark plugs when the module is assembled to the engine, at least two ignition coils carried by said housing, each ignition coil having a secondary winding, a plurality of conductors carried by said wall, each conductor being connected to a pad portion, a plurality of conductive springs, each spring electrically connecting a pad portion to one side of a said secondary winding, means respectively connecting each conductor carried by said wall to a respective conductor means carried by a respective tubular member, said conductors carried by said wall portion being arranged such that opposite ends of a secondary winding are respectively connected to a pair of spark plugs when said module is secured to said engine.

4. The ignition module according to claim 3 where the module has a metallic cover member that is secured to said housing, the cover member being adapted to be secured to said engine.

5. The ignition module according to claim 3 where the conductors that are carried by said wall are embedded in said wall.

6. The ignition module according to claim 3 where the ignition coil and said wall having overlapped tubular portions and wherein a said electrically conductive spring is disposed within said overlapped portions.

7. The ignition module according to claim 3 where the ignition module has a metallic cover that is secured to said housing that is adapted to be secured to an engine and wherein each ignition coil has a laminated metallic magnetic core that is clamped between said housing and said cover, each magnetic core directly contacting the metallic cover member.

* * * * *